US005364311A

United States Patent [19]

Chou

[11] Patent Number: 5,364,311

[45] Date of Patent: Nov. 15, 1994

[54] COLLAPSIBLE LABYRINTH

[76] Inventor: Hung-Tu Chou, No. 62, Chin Hsueh Road, Shan Hua Chen, Tainan Hsien, Taiwan, Prov. of China

[21] Appl. No.: 61,045

[22] Filed: May 14, 1993

[51] Int. Cl.[5] ..... A63J 11/00

[52] U.S. Cl. ..... 472/62; 160/135; 52/238.1

[58] Field of Search ..... 472/62, 67; 160/206, 160/199, 135; 273/153 R, 153 S; 52/238.1, 239, 243.1

[56] References Cited

U.S. PATENT DOCUMENTS

| | | | |
|---|---|---|---|
| 2,976,923 | 3/1961 | Hirashiki | 160/199 |
| 3,168,135 | 2/1965 | Beifuss | 160/199 |
| 4,064,590 | 12/1977 | Smith | 160/206 |
| 4,154,440 | 5/1979 | Rusk | 472/62 |
| 5,046,720 | 9/1991 | Bolly | 472/62 |
| 5,186,230 | 2/1993 | Ostrander | 160/199 |
| 5,219,316 | 6/1993 | Huffman | 472/62 |

*Primary Examiner*—Lanna Mai
*Assistant Examiner*—Kien Nguyen
*Attorney, Agent, or Firm*—Morton J. Rosenberg; David I. Klein

[57] ABSTRACT

A collapsible labyrinth is constructed with a plurality of collapsible separating boards temporarily secured by vertical pivotal posts, two horizontal bars respectively on and under a line of separating boards to secure upper and lower ends of the pivotal posts, and tenons fitting in a mortise in a lower end of each separating board and also in one of tenon holes preset in the ground for securing temporatily each separating board so that the boards can be altered in position to make up a labyrinth route.

1 Claim, 4 Drawing Sheets

COLLAPSIBLE LABYRINTH

BACKGROUND OF THE INVENTION

Prior art labyrinths of the type found in recreational or amusement centers for both children and adults to enter and find their way through are generally of fixed and immovable construction.

SUMMARY OF THE INVENTION

The subject invention is directed to a collapsible labyrinth. The walls of the subject collapsible labyrinth may be releasably joined to offer a variety of route configurations. The collapsible labyrinth of the present invention is constructed from a plurality of collapsible wall board members, each of which consist of two mated wall sections pivotally connected by a long securing post; and a plurality of horizontal locking bars which connect the ends of the long securing post of a plurality of wall board members to lock in place a labyrinth configuration. Each wall section of a wall board member has a tenon assembly captured within a mortise cavity formed into its bottom edge for insert into a cavity preformed into a ground surface. This secures a given wall board member and its constituent wall sections for a given labyrinth route configuration. The wall board members can be released, moved, and secured again to form a different labyrinth route configuration.

BRIEF DESCRIPTION OF THE DRAWINGS

The invention will be better understood with reference to the accompanying drawings, wherein.

DESCRIPTION OF THE PREFERRED EMBODIMENTS

Figure 1:
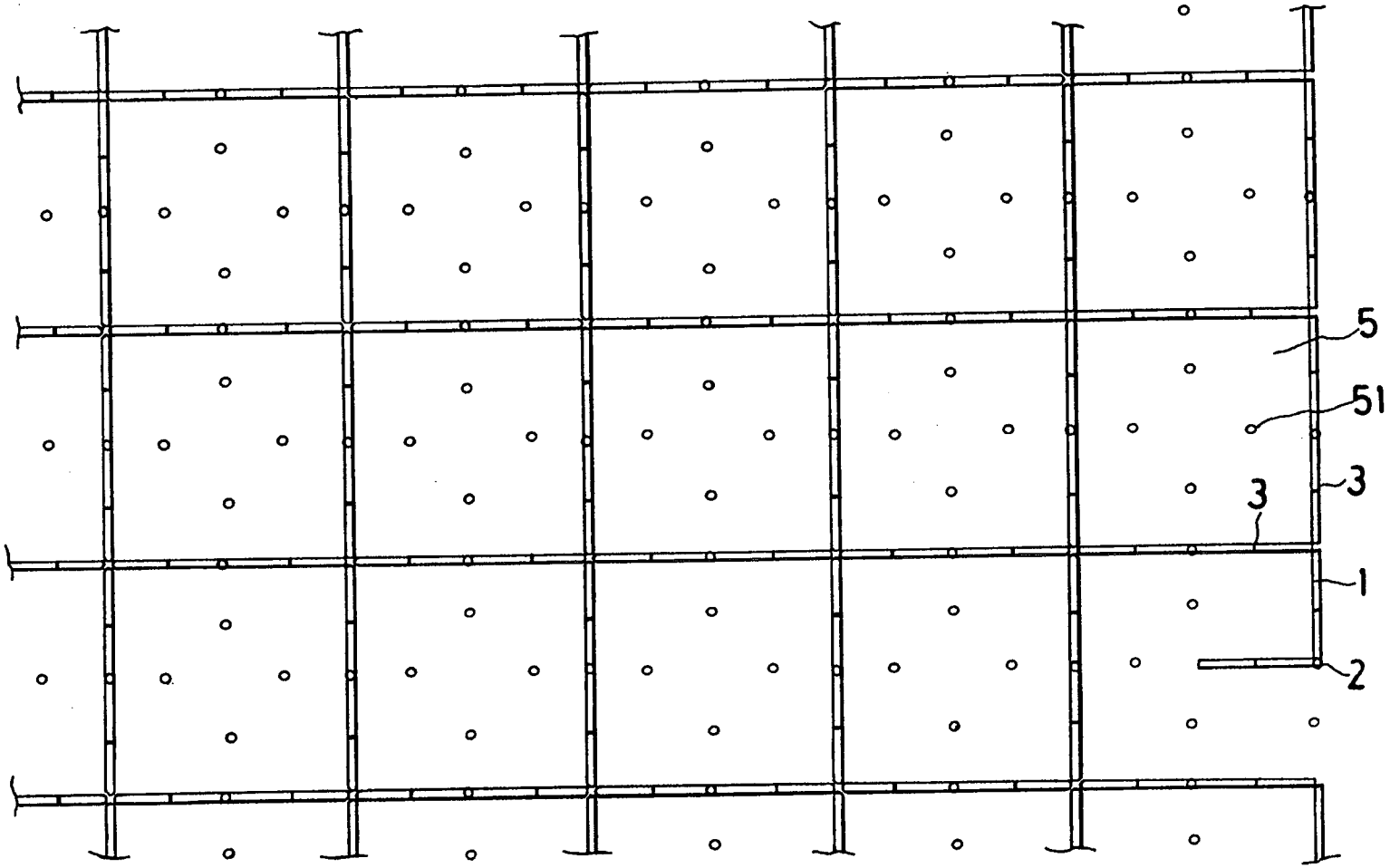
FIG. 1 is a top view of the preferred embodiment of the subject collapsible labyrinth.
Figure 2:
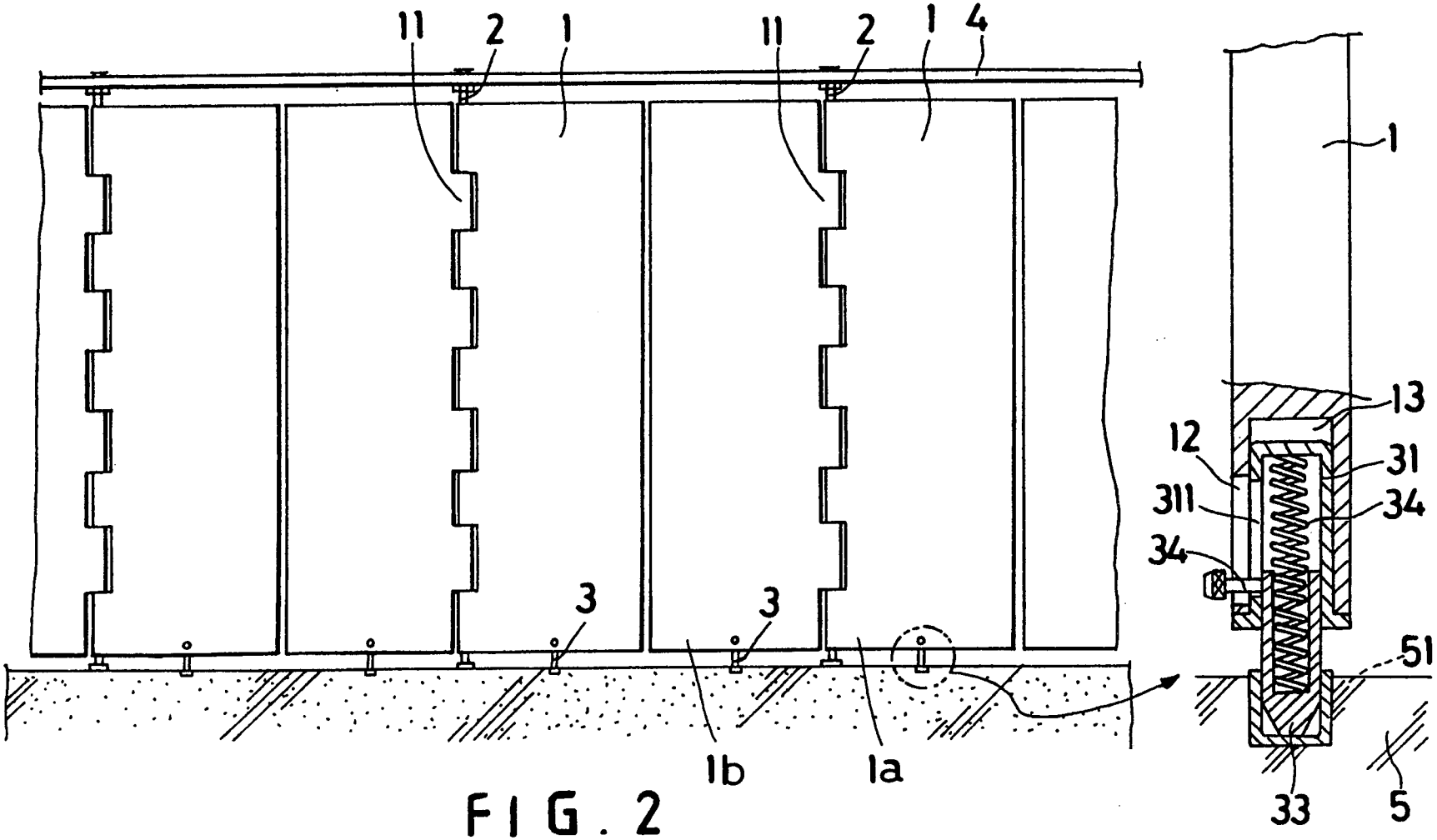
FIG. 2 is an elevational view of a plurality of wall board members pivotally coupled together in the preferred embodiment of the subject collapsible labyrinth.

A collapsible labyrinth in the present invention, as shown in FIGS. 1 and 2, includes a plurality of horizontal locking bars 4 and a plurality of collapsible wall board members 1, each wall board member 1 having a mated pair of wall sections 1*a*, 1*b* joined by a securing post 2. Each wall section 1*a*, 1*b* has a tenon assembly 3 captured within a mortise cavity 13 formed into its bottom edge.

Each wall section 1*a*, 1*b* generally has a rectangular shape, and a plurality of rectangular projections 11 along one side edge. The projections 11 on respective ones of the mated wall section 1*a*, 1*b* are formed so as to be insertable between the projections 11 of the other wall section.

Each tenon assembly 3 is captured within a hollow support member 31 having an inverted U-shape, and is spring-loaded therein by force of a coil spring 32. The tenon assembly 3 includes a U-shaped support peg member 3 that is inserted in one of many tenon holes preformed into a ground surface and retained therein by the spring force.

Support member 31 has an upper inner surface against which the captured coil spring 32 exerts an upward supporting force and two side surfaces, one of which has formed therein a vertical slot 311.

The upper portion of the support peg member 33 is captured within the support frame member 31, and a laterally-extending handle 34 is affixed to one side of the upper portion of the support peg member 33. Handle 34 extends laterally through both slot 311 formed in support member 3 and through slot 12 formed in wall section 1*a* or 1*b*. The handle 34 enables a user to place the support peg member 33 in a preformed hole 51 in the ground or to withdraw peg member 33 from hole 51 for labyrinth configuration by lifting it.

The horizontal locking bars 4 are provided to align and releasably lock together a plurality of securing posts 2 so that a labyrinth configuration can be stabilized.

A plurality of tenon holes 51 which receive the lower portions of the support peg members 33 of the tenon assemblies 3 to secure and stabilize the wall sections 1*a*, 1*b* are preformed into the ground where the labyrinth is to be installed.

Figure 4:
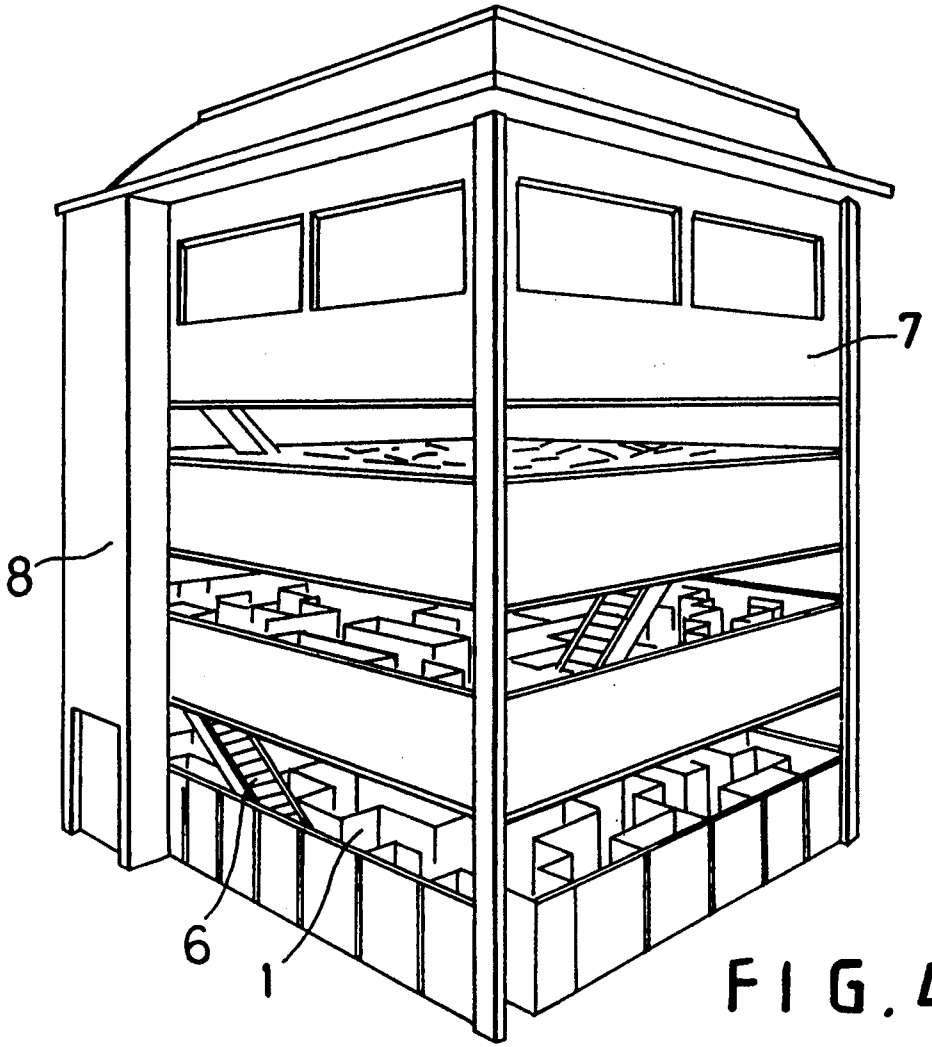

Referring to FIG. 4, a stairway may be placed between several levels of labyrinth floors. In this embodiment of the subject collapsible labyrinth, a restaurant or a buffet 7 is positioned at the highest floor to provide rest and nourishment to visitors who successfully make their way through the labyrinth.

Figure 3:
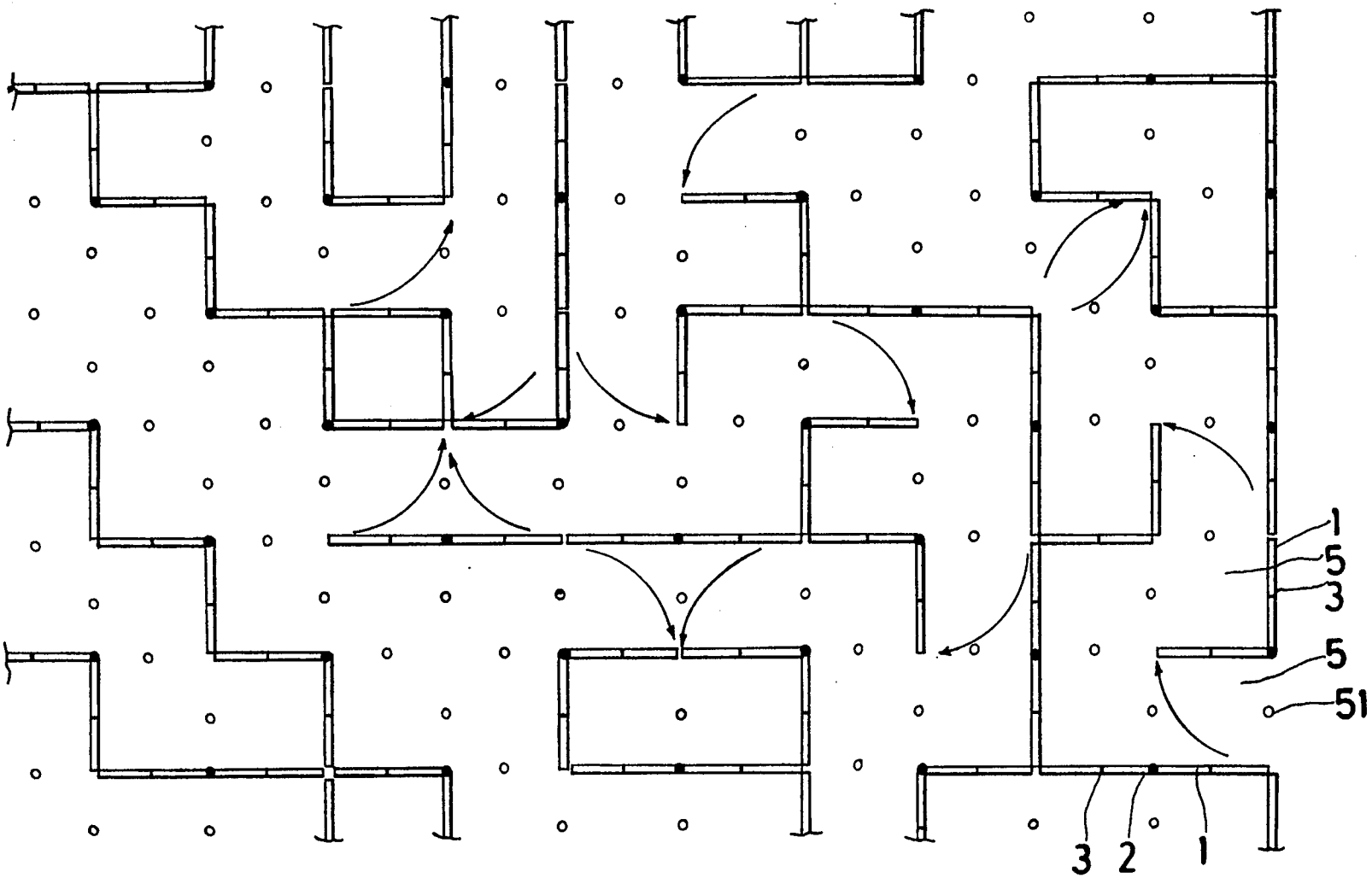
FIG. 3 is a top view of one possible route configuration of the preferred embodiment of the subject collapsible labyrinth; and, FIG. 4 is a perspective view of another possible route configuration of the preferred embodiment of the subject collapsible labyrinth.

The labyrinth route configuration shown in FIG. 3 may be obtained from the configuration shown in FIG. 1 by making the modifications to wall board member 1 layout, as indicated by the arrows. The necessary number of holes must be preformed into the ground, however, to accommodate such modifications.

While the preferred embodiments of the invention may have been described above, it will be recognized and understood that various modifications may be made therein, and the appended claims are intended to cover all such modifications which may fall within the spirit and scope of the invention.

What is claimed is:

1. A reconfigurable amusement labyrinth system comprising:

(a) a plurality of collapsible wall members, each of said collapsible wall members having at least a first wall section, at least a second wall section, and an elongated securing post having a cylindrical contour, each of said first and second wall sections having opposing sides forming a first surface and a second surface defining a thickness dimension, each of said first and second surfaces forming a planar contour extending in a longitudinal direction, said first wall section having a longitudinally extended first coupling edge having formed thereon a plurality of planar projections projecting substantially orthogonal to said longitudinal direction, said second wall section having a longitudinally extended second coupling edge having formed thereon a plurality of planar projections projecting substantially orthogonal to said longitudinal direction for insert between planar projections of said first coupling edge for releasable coupling therewith, said planar projections of each of said first and second coupling edges having longitudinally aligned openings for passage therethrough of said securing post, each of said first and second wall sections having a bottom edge which has formed therein a mortise cavity extending in a longitudinally upward direction, each of said first and second wall sections having formed therein a longitudinally extended first handle slot formed into said first surface adjacent said mortise cavity of said bottom edge;

(b) a plurality of securing tenon assemblies, each of said securing tenon assemblies having an inverted U-shaped support member for insert into said mortise cavity of said bottom edge of either of said first or second wall sections, a longitudinally extended spring biased support peg member captured within said support member for insert into a support cavity formed in a ground surface, and a release handle for said support peg member, said support member having formed therein a longitudinally extended second handle slot, said support member being inserted into said mortise cavity of said bottom edge of either first or second wall section whereby said second handle slot is substantially aligned with said first handle lot of said first surface of either said first or second wall section, said release handle being inserted through both said first and second handle slots and affixed to said support peg member; and, (c) a plurality of locking bars for aligning and transversely locking together a plurality of said securing posts of said collapsible wall members, each of said locking bars being elongated and releasably coupled to a first end of at least two of said securing posts.

* * * * *